US009400135B2

(12) United States Patent
Briglia et al.

(10) Patent No.: US 9,400,135 B2
(45) Date of Patent: Jul. 26, 2016

(54) PROCESS AND APPARATUS FOR THE SEPARATION OF AIR BY CRYOGENIC DISTILLATION

(75) Inventors: Alain Briglia, Corze (FR); Jian Wei Cao, Hangzhou (CN); Frederic Guyard, Paris (FR); Philippe Merino, Courbevoie (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 648 days.

(21) Appl. No.: 13/820,247

(22) PCT Filed: Sep. 9, 2010

(86) PCT No.: PCT/CN2010/076769

§ 371 (c)(1),
(2), (4) Date: Jun. 25, 2013

(87) PCT Pub. No.: WO2012/031399

PCT Pub. Date: Mar. 15, 2012

(65) Prior Publication Data

US 2013/0269387 A1 Oct. 17, 2013

(30) Foreign Application Priority Data

Jul. 5, 2010 (FR) ..... 10 55421
Jul. 5, 2010 (FR) ..... 10 55423

(51) Int. Cl.
*F25J 3/00* (2006.01)
*F25J 3/04* (2006.01)

(52) U.S. Cl.
CPC ..... *F25J 3/0449* (2013.01); *F25J 3/0409* (2013.01); *F25J 3/04024* (2013.01);

(Continued)

(58) Field of Classification Search
CPC ... F25J 3/0449; F25J 3/04496; F25J 3/04509; F25J 3/04812; F25J 3/04836; F25J 2230/32; F25J 2230/50; F25J 2235/50; F25J 2205/02; F25J 2205/01; F25J 2210/40; F25J 3/04024; F25J 3/0409; F25J 3/04412; F25J 3/04472–3/04515; F25J 2290/62
USPC ..... 62/643, 648, 652, 653, 654
See application file for complete search history.

(56) References Cited

U.S. PATENT DOCUMENTS 5,526,647 A 6/1996 Grenier
5,799,510 A 9/1998 Mostello (Continued)

FOREIGN PATENT DOCUMENTS

FR 2825136 11/2002
WO 2006003138 1/2006

OTHER PUBLICATIONS

PCT/CN2010/076769, International Search Report and Written Opinion, Jun. 30, 2011.

*Primary Examiner* — Keith Raymond
(74) *Attorney, Agent, or Firm* — Justin K. Murray

(57) ABSTRACT

An apparatus and process for separating air by cryogenic distillation includes a heat exchanger, a column system having at least one cryogenic distillation column, a conduit for supplying the column system with cooled air from the heat exchanger, a storage tank, a conduit for removing a liquid from the column system and sending it to the storage tank, at least one pump, at least one conduit for sending pumped liquid from the outlet of the or each pump to the heat exchanger, at least one conduit connected to the outlet of the pump or at least one outlet of at least one pump and to a column of the column system, said conduit passing directly to the column without passing via the storage tank.

10 Claims, 2 Drawing Sheets

(52) U.S. Cl.
CPC ..... *F25J 3/04406* (2013.01); *F25J 3/04412* (2013.01); *F25J 3/04478* (2013.01); *F25J 3/04496* (2013.01); *F25J 3/04509* (2013.01); *F25J 3/04781* (2013.01); *F25J 3/04812* (2013.01); *F25J 3/04836* (2013.01); *F25J 3/04963* (2013.01); *F25J 2205/02* (2013.01); *F25J 2210/40* (2013.01); *F25J 2230/32* (2013.01); *F25J 2230/50* (2013.01); *F25J 2235/50* (2013.01); *F25J 2245/50* (2013.01); *F25J 2290/62* (2013.01)

(56) References Cited

U.S. PATENT DOCUMENTS

| | | | | |
|---|---|---|---|---|
| 5,953,937 | A * | 9/1999 | Corduan ..... | F25J 3/0409 62/646 |
| 6,062,044 | A * | 5/2000 | Bernard ..... | F25J 3/0409 62/647 |
| 6,487,877 | B1 | 12/2002 | Griffiths et al. | |
| 2006/0010909 | A1 | 1/2006 | Briglia et al. | |

* cited by examiner

PROCESS AND APPARATUS FOR THE SEPARATION OF AIR BY CRYOGENIC DISTILLATION

CROSS REFERENCE TO RELATED APPLICATIONS

This application is a §371 of International PCT Application PCT/CN2010/076769, filed Sep. 9, 2010, which is herein incorporated by reference in its entirety.

TECHNICAL FIELD OF THE INVENTION

The present invention relates to a process and apparatus for the separation of air by cryogenic distillation. In particular it relates to a process for the separation of air in which a liquid product is withdrawn from a cryogenic distillation column, stored in a storage tank, pressurized and then vaporized to form a gaseous product.

BACKGROUND

In order to improve plant reliability, it is frequently necessary to install several pumps running in parallel to pressurize the liquid withdrawn from the cryogenic distillation column.

For instance, there may be two pumps operating in parallel, each pump being sized to pressurize between 50% and 100% of the total gaseous oxygen flow. Alternatively there may be three pumps operating in parallel, each pump being sized for between 33% and 50% of the total gaseous oxygen flow.

The advantage of these configurations is that, in case of failure of one of the pumps, the total flow of pumped liquid can come back to the 100% value in a very short time thanks to the ramp-up of the pumps remaining in operation, thus ensuring the stability of the production in terms of pressure. This is a key parameter for some down-stream equipment fed by the gaseous oxygen since the equipment may trip if the pressure drop is too large.

In practice, the configurations described above are difficult to implement due to the fact that pump suppliers have trouble manufacturing a pump which can handle such high operating ranges. The pumps have to function during turndown of the air separation unit with all the pumps running but also during full operation of the air separation unit with one pump out of action. In a normal configuration, this situation could be handled by recycling the liquid discharged by the pump so as to build up its load, but in the case where production pumps are located downstream of a storage tank, recycling the pumped liquid to the storage would lead to a critical loss of oxygen molecules by flash, directly impacting the recovery of the air separation unit.

SUMMARY OF THE INVENTION

One aim of the present invention is to operate an air separation unit with a single pump or several pumps in parallel but at the same time to ensure flexibility of the load of the plant.

Certain embodiments of the process are more efficient and more stable than that of the prior art.

According to one aspect of the invention, there is provided a process for separating air by cryogenic distillation in which:

a) compressed and purified air is cooled in a heat exchanger and then sent to a column of a column system to be distilled
b) a liquid is withdrawn from a column of the column system and sent to a storage tank c) a stored liquid is removed from the storage tank and pressurized using at least one pump
d) a first stream of pressurized liquid from at least one pump is sent to the heat exchanger and vaporized to form a gaseous product
e) a second stream of pressurized liquid from the at least one pump or a fluid derived from the second stream is sent to a column of the column system.

According to other optional features:

the column system comprises a high pressure column and a low pressure column and the second stream of pressurized liquid from the at least one pump or the fluid derived from the second stream is sent to the low pressure column.

the second stream of pressurized liquid is expanded to form a gaseous fraction and a liquid fraction, the gaseous fraction is sent to a column of the column system and the liquid fraction is preferably sent to the storage tank.

the stored liquid is pressurized using at least one pump, preferably at least two pumps, and the second stream of pressurized liquid from the at least one pump or the fluid derived from the second stream is sent to the column if the amount of gaseous product required is lower than a given threshold.

the fluid derived from the second stream is derived by separating the second stream in a phase separator and the gas from the phase separator is sent to the column system.

According to a further aspect of the invention, there is provided an apparatus for separating air by cryogenic distillation comprising a heat exchanger, a column system comprising at least one cryogenic distillation column, a conduit for supplying the column system with cooled air from the heat exchanger, a storage tank, a conduit for removing a liquid from the column system and sending it to the storage tank, at least one pump, at least one conduit for sending pumped liquid from the outlet of the or each pump to the heat exchanger, at least one conduit connected to the outlet of the pump or at least one outlet of at least one pump and to a column of the column system, said conduit passing directly to the column without passing via the storage tank.

The column system may comprise a high pressure column and a low pressure column and the outlet of the pump or at least one outlet of at least one pump is connected to the low pressure column.

The apparatus may comprise a phase separator, the at least one conduit connected to the outlet of the pump or at least one outlet of at least one pump being connected to the column of the column system via the phase separator.

The phase separator may be connected to the storage tank.

At least one conduit may link the outlet of at least one pump to the top of the storage tank.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
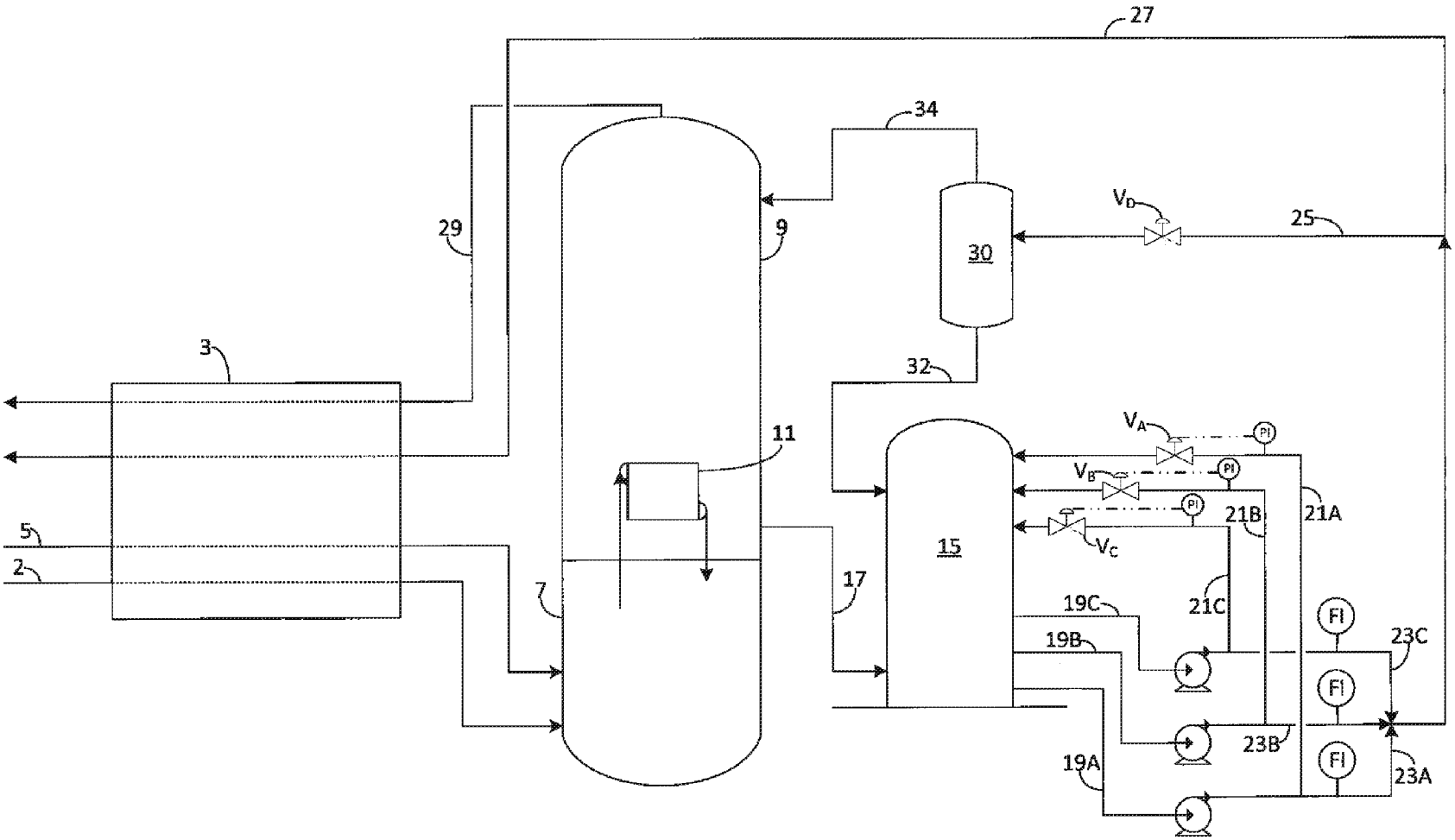
FIG. 1 represents an apparatus in accordance with an embodiment of the invention.

The invention will be described in greater detail by referring to FIG. 1, which illustrates an air separation unit according to an embodiment of the invention.

The air separation unit 1 comprises a heat exchanger 3, a double column made up of a high pressure column 7 and a low pressure column 9, a thermal link being provided between the top of column 7 and the bottom of column 9 via a reboiler 11. Air streams 2 and 5 cooled in heat exchanger 3 and separated in the double column. The conduits between the two columns are not shown for clarity. Waste nitrogen 29 is removed from the low pressure column 9 and warmed in exchanger 3. Liquid oxygen 17 is removed from the bottom of low pressure column 9 and sent to a storage tank 15. Liquid oxygen is withdrawn from the storage tank 15 of the flat bottom or vacuum jacket type and sent to the pumps P41A, P41B and P41C via conduits 19A, 19B and 19C respectively. Each pump is sized for both 33% and 50% of the total flow.

The outlets of the pumps P41A, P41B and P41C are connected to valves VA, VB and VC via conduits 23A, 23B, 23C and 21A, 21B, 21C. These valves are recycle valves which are needed to start the pumps in order to avoid functioning in the cavitation zone. These valves are also used in operation in case the flow of a given pump becomes too small. In this case, the pressure measured at the outlet of the pump will become higher than usual, and above a certain value, the recycle valves will open thanks to a pressure indicator on each valve.

The conduits 23A, 23B, 23C are also connected to a conduit 25 and a conduit 27. Conduit 25 is connected to the low pressure column 9 via a valve VD which a common recycle valve. Conduit 27 is the product conduit which provides pumped liquid oxygen to the heat exchanger 3 to be vaporized to form a gaseous product under pressure.

The advantage of the scheme described above is that if the plant is running at any load (within the operating range of the air separation unit) the three pumps can operate in parallel, ensuring a quick take over of the production at any load without impacting oxygen recovery, thus ensuring the competitiveness of the technical solution for efficiency and production stability.

With this configuration, the pumps will deliver the minimum flow that the three pumps can deliver when they are running in parallel (this flow being stipulated by pump supplier) and yet only send the required flow to the main heat exchanger for vaporization. This can be done by recycling the excess flow to the low pressure column in the cold box via conduit 25 and valve $V_D$ without losing oxygen molecules.

Figure 2:
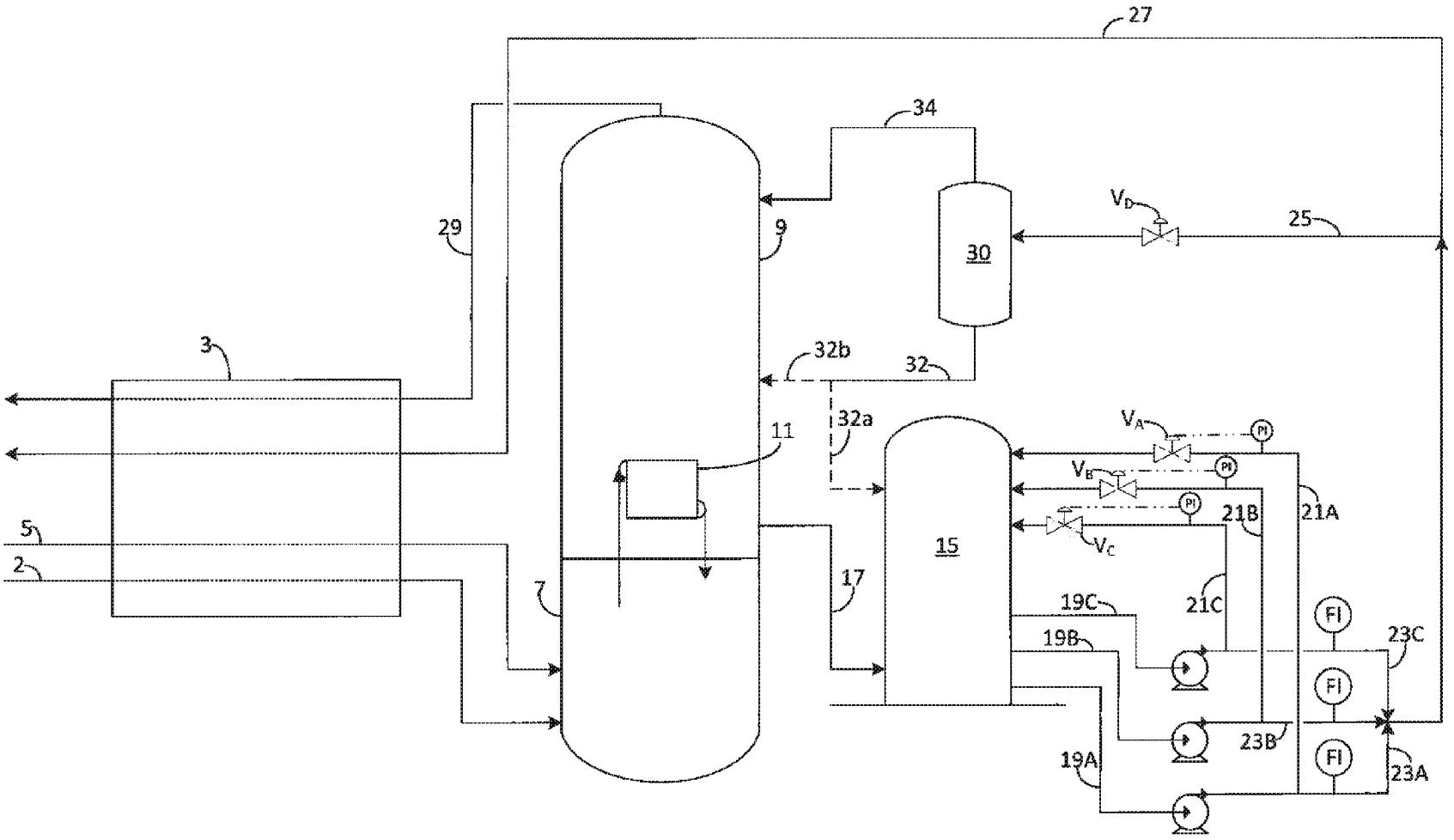
FIG. 2 represents an apparatus in accordance with an embodiment of the invention.

The recycle flow can be sent to the cold box 13 in different ways:

- the liquid oxygen conduit 25 can be directly connected to a column, as shown in FIG. 1;
- the liquid oxygen conduit can be connected to a phase separator 30 in which liquid 32 and gas 34 are separated, and the liquid 32 being sent to the storage tank 15 and gas 34 sent to the column 7 or 9, as shown in FIG. 2.

It is more beneficial to send the liquid oxygen back to the low pressure column 9 since the liquid oxygen composition is that of the bottom liquid.

Therefore, this recycle line will be used continuously in cases where we want to use several pumps in parallel for plant low loads.

An estimation of the benefits in terms of efficiency brought by such configuration in a typical case with oxygen at 88 bar compared to a classical situation using three pumps to pressurize the liquid oxygen for quick response:

| Load of ASU | Number of pumps running | Oxygen recovery without recycling to cold box (%) | Oxygen recovery with recycling to cold box (%) (invention) |
|---|---|---|---|
| 100% | 3 | 98.9 | 99.5 |
| 90% | 3 | 98.1 | 99.4 |
| 80% | 3 | 96.7 | 99.3 |

The following table gives an estimation of the benefits in terms of responsiveness brought by such configuration compared to a classical situation where we want to ensure reasonable plant efficiency:

| | Oxygen recovery without recycling to cold box | | | Oxygen recovery with recycling to cold box (invention) | | |
|---|---|---|---|---|---|---|
| Load of ASU | # of running pumps | Time response | Oxygen recovery | # of running pumps | Time response | Oxygen recovery |
| 100% | 3 | 5 sec | 99.5 | 3 | 5 sec | 99.5 |
| 90% | 2 | 60 sec | 99.5 | 3 | 5 sec | 99.4 |
| 80% | 2 | 60 sec | 99.5 | 3 | 5 sec | 99.3 |

It will be understood that the invention applies to the case where there is a single pump or more than one pump. If there is only one pump and this pump is required to produce small amounts of liquid, the invention can be used to allow the pump to pressurize a larger amount of liquid and then send the surplus pumped liquid back to the column.

The conduits 21A to 21C are used to send liquid from the pumps back to the top of the storage tank 15 in the case where the recycle to the low pressure column is not in operation.

In some cases, the valves VA to VC and valve VD may be in operation simultaneously. For example in the case where the air separation unit is not functioning, liquid can still be removed from storage tank 15 and vaporized for example in a back up vaporizer (not shown). In this case, the pressure at the storage tank increases, and the amount of gas generated due to the flash is vented to the atmosphere by the storage vent (not represented)

If one of the pumps breaks down, it is possible to maintain the total flow, the (possibly two) remaining pump or pumps will then ramp-up to their maximum flow (50% of the total flow), and no recycling through conduit 25 and valve VD is necessary The invention also applies to the case where liquid nitrogen is pumped, in which case it is preferable to recycle the liquid back to the low pressure column or the high pressure column depending on the pressures involved.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from one particular value and/or to the other particular value, along with all combinations within said range.

All references identified herein are each hereby incorporated by reference into this application in their entireties, as well as for the specific information for which each is cited.

The invention claimed is:

1. A process for separating air by cryogenic distillation, the process comprising the steps of:

a) cooling compressed and purified air in a heat exchanger and then distilling in a column of a column system;

b) withdrawing a liquid from a column of the column system and sending to a storage tank;

c) removing a stored liquid from the storage tank and pressurizing using at least one pump;

d) sending a first stream of pressurized liquid from the at least one pump to the heat exchanger to be vaporized to form a gaseous product; and e) expanding a second stream of pressurized liquid from the at least one pump or a fluid derived from the second stream to form a gaseous fraction and a liquid fraction and sending the gaseous fraction to a column of the column system.

2. The process according to claim 1, wherein the column system comprises a high pressure column and a low pressure column and the second stream of pressurized liquid from the at least one pump or the fluid derived from the second stream is sent to the low pressure column.

3. The process according to claim 1, wherein the liquid fraction is sent to the storage tank.

4. The process according to claim 1, wherein the stored liquid is pressurized using at least one pump, and the second stream of pressurized liquid from the at least one pump or the fluid derived from the second stream is sent to the column if the amount of gaseous product required is lower than a given threshold.

5. The process according to claim 1, wherein the liquid fraction is sent to a low pressure column of the column system.

6. The process according to claim 4, wherein the stored liquid is pressurized using at least two pumps.

7. A process for separating air by cryogenic distillation, the process comprising the steps of:

a) cooling compressed and purified air in a heat exchanger and then distilling in a column of a column system;

b) withdrawing a liquid from a column of the column system and sending to a storage tank;

c) removing a stored liquid from the storage tank and pressurizing using at least one pump;

d) sending a first stream of pressurized liquid from the at least one pump to the heat exchanger to be vaporized to form a gaseous product; and e) sending a second stream of pressurized liquid from the at least one pump or a fluid derived from the second stream to a column of the column system, wherein the fluid derived from the second stream is derived by separating the second stream in a phase separator and the gas from the phase separator is sent to the column system.

8. An apparatus for separating air by cryogenic distillation comprising:

a heat exchanger;

a column system comprising a high pressure column and a low pressure column, the column system being fluidly connected with the heat exchanger such that the column system is configured to receive cooled air from the heat exchanger and then separate the cooled air into nitrogen and oxygen;

a storage tank in fluid communication with the column system such that the storage tank is configured to receive liquid oxygen from the column system;

at least one pump in fluid communication with an outlet of the storage tank and the heat exchanger, wherein the at least one pump is configured to pressurize a liquid received from the storage tank to form a compressed liquid and then send a first fraction of the compressed liquid to the heat exchanger for vaporization;

an expansion device in fluid communication with the at least one pump, wherein the expansion device is configured to receive a second fraction of the compressed liquid from the at least one pump and expand the second fraction of the compressed liquid to form an expanded fluid comprising a gaseous fraction and a liquid fraction; and a phase separator in fluid communication with and downstream of the expansion device, wherein the phase separator is configured to receive the expanded fluid and separate the expanded fluid into the gaseous fraction and the liquid fraction, wherein a top portion of the phase separator is in fluid communication with the column system such that the phase separator is configured to send the gaseous fraction to the column system.

9. The apparatus according to claim 8, wherein a bottom portion of the phase separator is in fluid communication with the storage tank, such that the phase separator is configured to send liquid to the storage tank.

10. The apparatus according to claim 8, wherein the expansion device is an expansion valve in fluid communication with the at least one pump, wherein the expansion valve is configured to receive a third fraction of the compressed liquid from the at least one pump and expand the third fraction of the compressed liquid to for a second expanded fluid, wherein the expansion valve is in fluid communication with an inlet of the storage tank such that the inlet of the storage tank is configured to receive the second expanded fluid from the expansion valve.

* * * * *